United States Patent [19]

DeLucia

[11] 4,438,605

[45] Mar. 27, 1984

[54] CONTINUOUS, MOVEABLE THERMAL BARRIER SYSTEM

[76] Inventor: Paul V. DeLucia, Rte. 82, R.D. 6, Box 85, Hopewell Junction, N.Y. 12533

[21] Appl. No.: 312,713

[22] Filed: Oct. 19, 1981

[51] Int. Cl.[3] ..... E04B 1/344; A47G 5/00

[52] U.S. Cl. ..... 52/71; 160/135; 16/225; 16/227

[58] Field of Search ..... 52/71; 160/229, 231, 160/206, 135; 405/281, 279; 16/225, 227, DIG. 13

[56] References Cited

U.S. PATENT DOCUMENTS

| | | | |
|---|---|---|---|
| 859,295 | 7/1907 | Hill | 405/281 |
| 1,098,077 | 5/1914 | Annison | 405/279 |
| 1,841,759 | 1/1932 | Nolte | 405/281 |
| 2,607,411 | 8/1952 | Van Vliet | 160/231 R |
| 2,978,020 | 4/1961 | Paulsrude | 16/225 |
| 3,297,077 | 1/1967 | Garbus | 160/206 |
| 3,324,930 | 6/1967 | Colombo | 160/231 R |
| 3,889,736 | 6/1975 | Firks | 160/229 R |

*Primary Examiner*—James L. Ridgill, Jr.
*Attorney, Agent, or Firm*—Joseph L. Spiegel

[57] ABSTRACT

A continuous, moveable thermal barrier system includes a plurality of insulating panels positioned in edge-to-edge relationship and a plurality of insulation means extending between edges of adjacent panels joining same in moveable, sealing relationship.

10 Claims, 11 Drawing Figures

CONTINUOUS, MOVEABLE THERMAL BARRIER SYSTEM

BACKGROUND OF THE INVENTION

1. Field of the Invention

This invention relates to continuous, moveable thermal barrier systems. 2. Description of the Prior Art It is known that a substantial portion of energy flow in the form of heat to and from a building structure is through openings in the structure, that is, at windows, doorways and the like.

In the past, various moveable thermal barriers have been suggested in the form of folding and sliding panels that seal off and insulate windows, doors and the like from heat loss at night and to shield the entry of direct sunlight during the daytime when solar heat may be excessive.

A problem associated with such moveable, thermal barriers is that they are not truly continuous in nature. Typically, the barrier comprises a plurality of panels pivotally joined in some fashion in end-to-end relationship. At the pivotal junction, however, as well as at the top and bottom of the panels, the barrier is not resistant to the flow of energy, permitting energy flow therethrough, drafts and the like.

SUMMARY OF THE INVENTION

Accordingly, an object of the invention is a continuous, moveable, thermal barrier system.

Another object is such a system with improved resistance to thermal energy flow therethrough.

Still another object is a hinge assembly for use in such a system, which assembly is itself resistant to the flow of thermal energy therethrough.

A further object is ease of production, assembly and installation of the system.

BRIEF DESCRIPTION OF THE DRAWING

Other objects and advantages of the invention will be apparent from the following detailed description and accompanying drawing wherein.

DETAILED DESCRIPTION

As noted above, a problem associated with thermal barriers is that they are not truly continuous in nature in that at the pivotal junctions or hinges, the barrier is not resistant to the flow of energy, permitting energy flow therethrough, drafts and the like.

Figure 1:
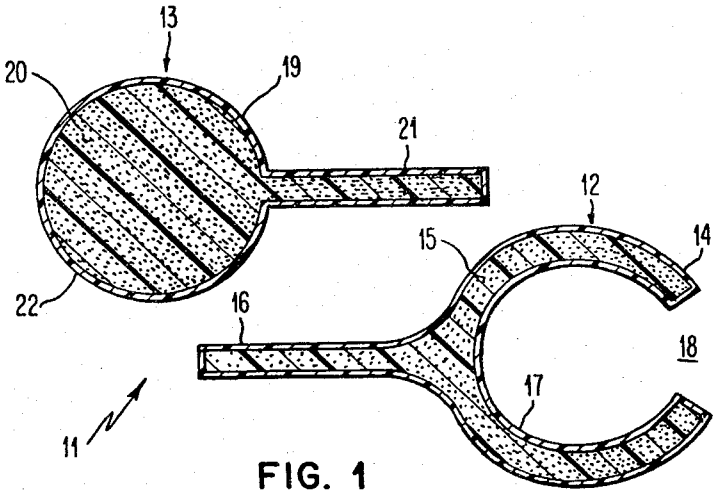
FIG. 1 is a cross sectional view of one embodiment of the hinge members of the hinge assembly of the present invention.

One embodiment of a hinge assembly 11 overcoming prior art objections is illustrated in FIG. 1 as comprising first and second hinge members 12, 13.

Figure 1A:
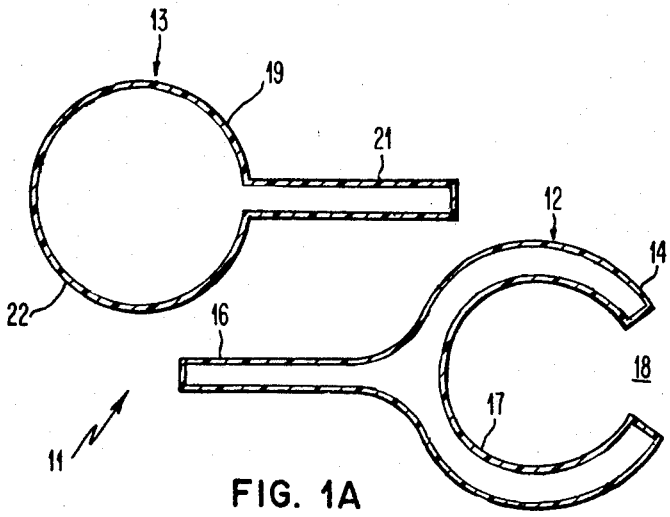
FIG. 1A is a view similar to FIG. 1, but with hollow hinge members.

Elongated hinge member 12 is an extruded plastic outer shell 14, as, for example, polyvinyl chloride, which may be hollow (FIG. 1A) or, as illustrated, filled with insulating foam material 15, as, for example, polyurethane foam. Such material has a very high R-factor, on the order of R-8 per inch.

Hinge member 12 includes a flat surface portion 16 for mounting upon a panel (not shown) and socket member 17. In the embodiment disclosed the socket 17, while close to being cylindrical in cross section is in reality pear-shaped or egg-shaped, tapering tighter at 18 toward the opening.

Elongated hinge member 13 is comprised of an extruded plastic shell 19 which may be hollow (FIG. 1A) or, as illustrated, filled with insulating foam material 20. In those instances where the shell 14 or 19 is left hollow, the air within acts as an insulation.

Hinge member 13 includes a flat surface portion 21 for mounting upon a panel (not shown) and a cylindrical portion 22. The radius of cylindrical portion 22 corresponds with that of the radius of the socket 17 where its radius is largest, that is, from the center of its opening to a non-tapered point on the interior wall of socket 17.

Figure 2:
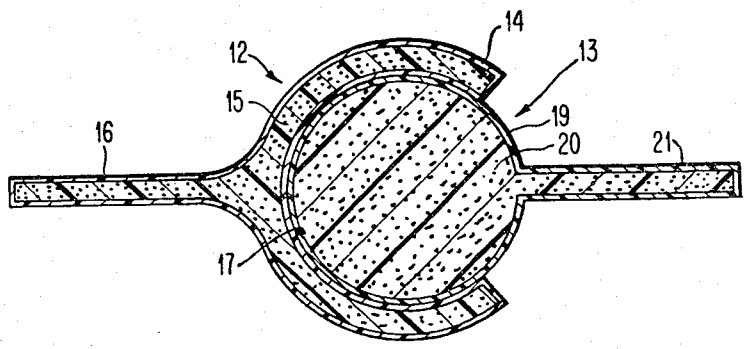
FIG. 2 is a cross sectional view of the hinge assembly of FIG. 1 shown with the second hinge member inserted within the first in press fit relationship.

In use cylindrical portion 22 is press fit lengthwise within socket 17 (FIG. 2). The socket 17 will assume the shape of the cylindrical portion 22 thereby creating a seal therebetween.

Alternatively, socket 17 may be perfectly cylindrically shaped as well as the cylindrical portion 22, with the cylindrical portion 22 being of a radius slightly larger than that of the interior of socket 17. The cylindrical portion 22 is then constructed of a material that will compress when the two members are pressed together. Upon insertion, a seal is created therebetween.

It is seen then that a press fit seal can be created if at least one of the members, cylindrical portion 22 or socket 17 is flexible relative to the other. Because of choice of material, the assembly is resistant to transmission of thermal energy. With the use of the plastics discussed, the assembly is self-lubricating, and resistant to corrosion.

The hinge assembly 11 has a limited rotation defined by the angle of the opening in socket 17. The angle must be somewhat less than 180° in order to prevent cylindrical portions 22 from slipping out. The type of material utilized will determine the limitation of the angle of the opening of socket 17. Most rigid materials will enable a larger opening angle, but in no event 180° or more.

Rotation of the hinge assembly 11 is also limited by the thickness of the mounting portion 21 extending from the cylindrical portion 22.

Figure 3:
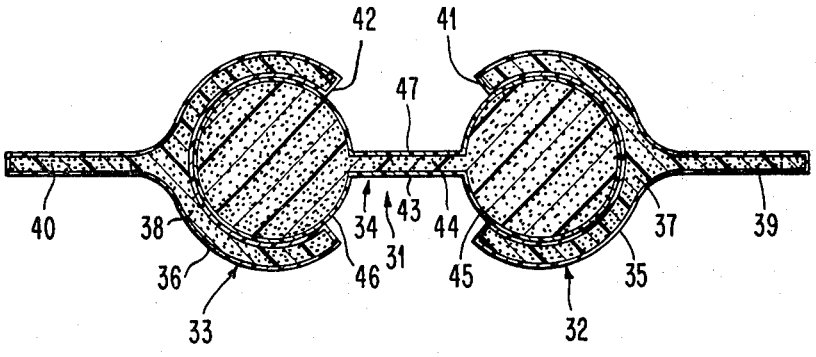
FIG. 3 is a cross sectional view of a hinge assembly that permits rotation about two parallel axes.

FIG. 3 discloses a hinge assembly 31 comprising a pair of separate, spaced-apart, elongated hinge members 32, 33 and an elongated connecting section 34 extending therebetween.

Figure 3A:
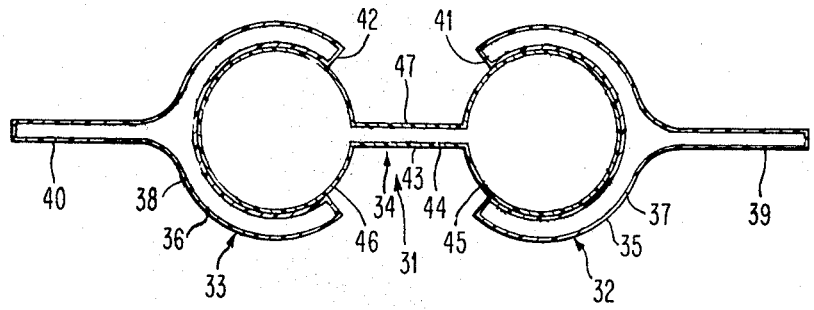
FIG. 3A is a view similar to FIG. 3, but with hollow hinge members.

Hinge members 32, 33 are comprised of extruded plastic shells 35, 36 which may be hollow (FIG. 3A) or, as illustrated, filled with insulating foam material 37, 38.

Hinge members 32, 33 include flat mounting portions 39, 40 and open socket members 41, 42.

Connecting section 34 is comprised of an extruded plastic shell 43 which may be hollow (FIG. 3A) or, as illustrated, filled with insulating foam material 44.

Connecting section 34 includes a pair of opposed cylindrical members 45, 46 and, preferably, a rigid link 47 extending therebetween. If the link 47 is flexible, instead of rigid, the link may wear, as the polymers break down.

In use the socket members 41, 42 of hinge members 32, 33 are press fit over the cylindrical members 45, 46.

Assembly 31 permits rotation about two parallel axes with rotation being limited by the angle of the opening in sockets 41, 42 and the thickness of rigid link 47. The mounting portions 39, 40 serve as references for the degree of rotation.

As with the embodiment depicted in FIGS. 1 and 2, a press fit seal can be created if the socket members 41, 42 or cylindrical members 45, 46 are flexible relative to the other.

Figure 4:
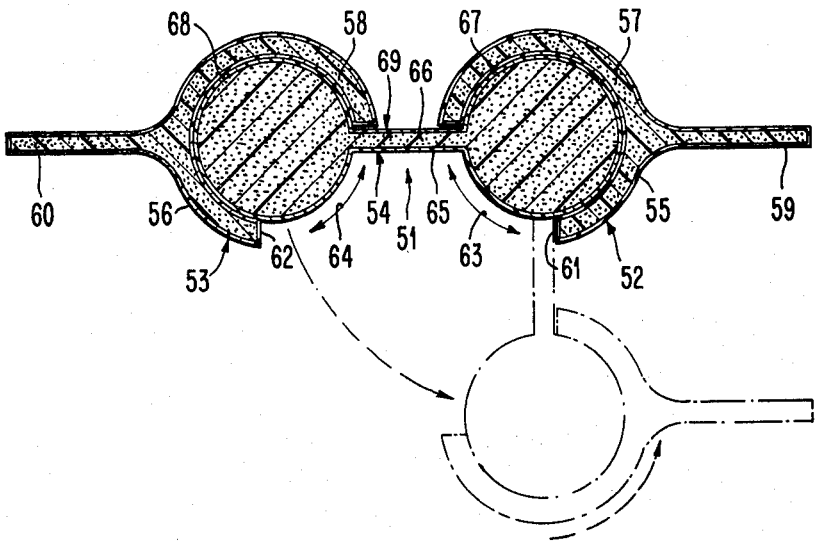
FIG. 4 is a cross sectional view of a hinge assembly that permits 180° rotation of the flat mounting portions relative to each other.

FIG. 4 discloses a hinge assembly 51 that permits 180 degree rotation and about two parallel axes.

Assembly 51 comprises a pair of separate, spaced-apart, elongated hinge members 52, 53 and an elongated connecting section 54 extending therebetween.

Figure 4A:
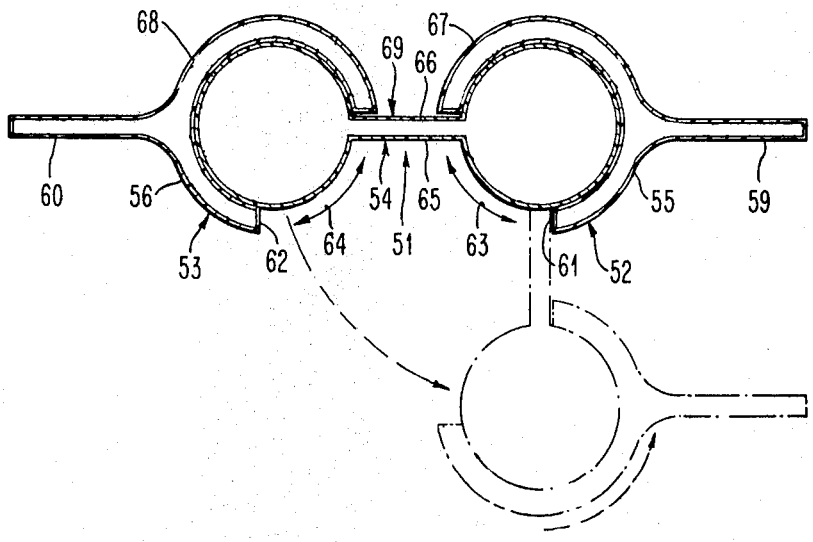
FIG. 4A is a view similar to FIG. 4, but with hollow hinge members.

Hinge members 52, 53 are comprised of extruded plastic shells 55, 56 which may be hollow (FIG. 4A) or, as illustrated, filled with insulating foam material 57, 58.

Hinge members 52, 53 include flat mounting portions 59, 60 and open, generally cylindrical socket members 61, 62 with the further limitation that the angular openings 63, 64 be of such size (illustrated as 90°) and positioned from 180° to 270° from the mounting portions 59, 60.

Connecting section 54 is comprised of an extruded plastic shell 65 which may be hollow (FIG. 4A) or, as illustrated, filled with insulating foam material 66.

Connecting section 54 includes opposed cylindrical members 67, 68 and a rigid link 69 therebetween.

In use the socket members 61, 62 of hinge members 52, 53 are press fit over the cylindrical members 67, 68 of connecting sections 54.

Assembly 51 permits 180° rotation of the flat mounting portions 59, 60 relative to one another such that panels or plane portions to which the mounting portions 59, 60 are attached may be swung from end-to-end relationship to a folded side-to-side relationship (shown in phantom).

Thus far hinge assemblies to be used as part of a continuous, moveable thermal barrier system have been described. Attention is now directed to the system incorporating such hinge assemblies.

Figure 5:
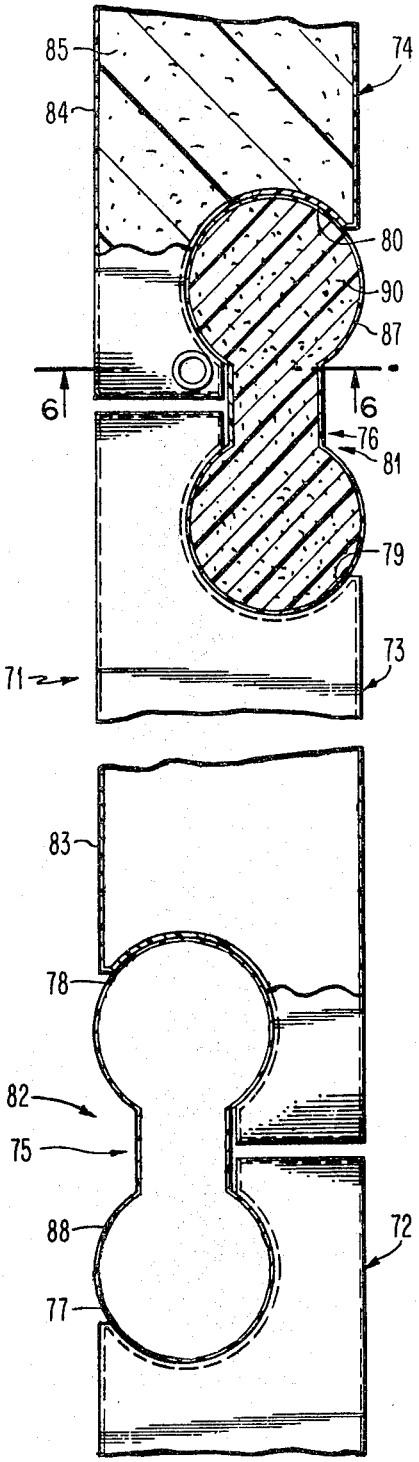
FIG. 5 is an orthographic top sectional view, partially cut away, of a portion of a continuous, moveable thermal barrier system illustrating the panels and hinge assembly.

Referring now to FIG. 5, a continuous, moveable thermal barrier system 71 is seen as including a plurality of panels 72, 73, 74 hinge assemblies 75, 76 formed by socket members 77, 78 and 79, 80 at adjacent corners and on opposite sides of the panels and connecting sections 81 and 82 extending therebetween.

Each panel 72, 73, 74 is comprised of an extruded plastic outer shell 83, 84, as, for example, polyvinyl chloride, which may be hollow or, as illustrated, filled with an insulating foam material 85. Choice of materials to be utilized in the construction of the panels and their connecting hinge members will depend upon their application. For example, on certain installations it may be desirable to cover the flat surfaces of the panels with a ceramic material in order to achieve a more fire resistant product. Non combustible insulating materials may also be used within the pWPanels and hinge members. The panel shell could be made in two halves, aluminum on the outside flat surfaces, and plastic on the interior. It is also possible to make the panels entirely of aluminum, but with a thermal break of plastic where the aluminum shell halves are joined.

At opposite corners, panels 72, 73, 74 are provided with socket members, as, for example, 77, 80, 78, 79 illustrated. The sockets 77–80 initially, while close to being cylindrical in cross-section, are in reality pear-shaped or egg-shaped, tapering tighter toward the opening, as with the socket member 17 of FIG. 1.

Connecting sections 81, 82 are comprised of an outer extruded plastic shell 87, 88 which may be hollow or, as illustrated, filled with an insulating foam material 90.

Figure 6:
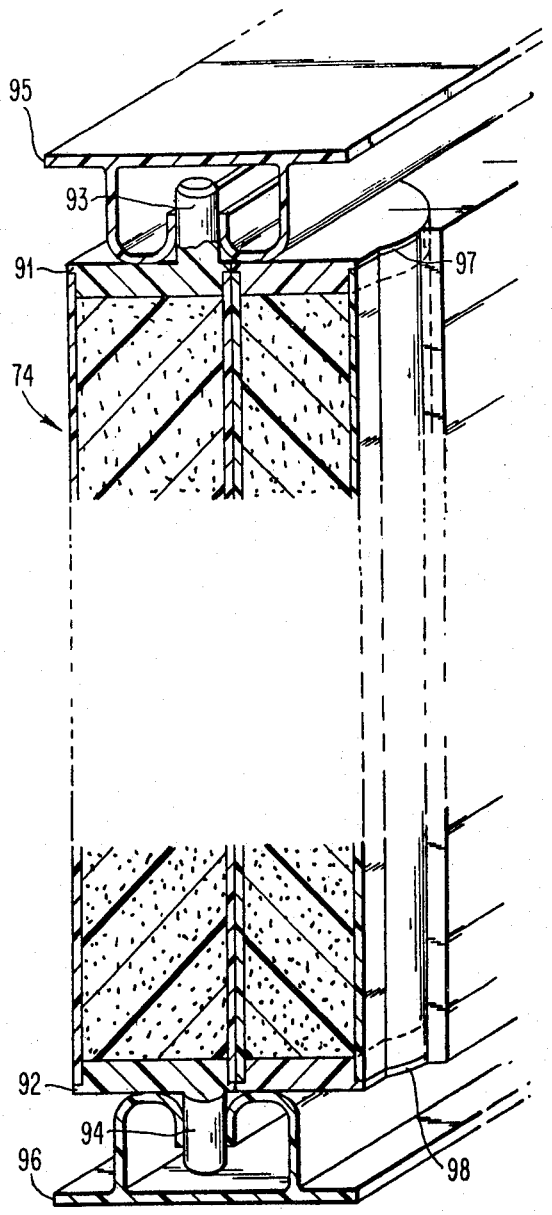
FIG. 6 is an oblique cross sectional view depicting the interior, side elevation and cutting plane through the panels in FIG. 5 mounted in a track assembly.

Referring to FIG. 6, panels 72, 73, 74 are also provided with injection molded plastic top 91 and bottom 92 end plates. The panels are also provided with pins 93, 94 for mounting and riding within upper and lower track guides 95, 96. Pins 93, 94 may extend from the connecting sections or, alternatively, as shown, from the panel end plates. The track guides 95, 96 are of extruded plastic material that may be compressed.

In use, the panels 72, 73 and 74 are pressed into the track guides 95, 96. The pins 93, 94 extend part-way into the track guides 95, 96. As the tops and bottoms of the panels press against the tracks, they create a seal along the entire top and bottom of the system. The compressible nature of the tracks also allows for expansion and contraction of the panels. Depending on the application, in certain instances, one or more of the panels can be translucent or clear plastic to admit light or see through. Translucent or clear foams are also available to fill such particular panels. An example where one would want to have a translucent or clear panel is when the system is utilized to cover skylights or windows during the day.

Figure 7:
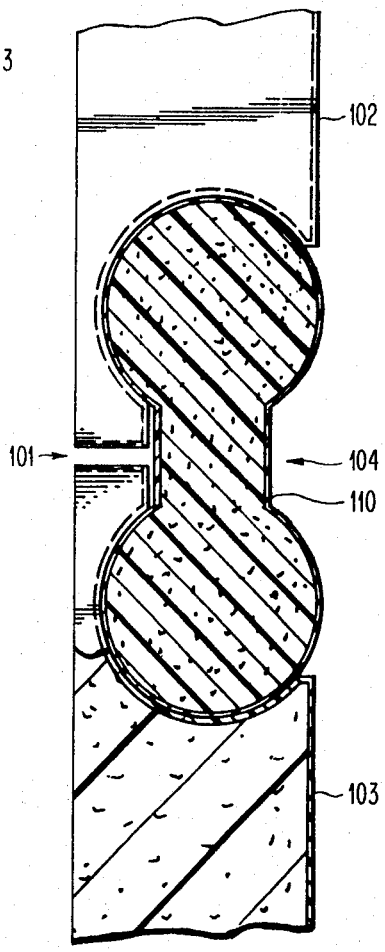
FIG. 7 is a cross sectional view, partially cut away, of an alternate embodiment of a continuous moveable thermal barrier system illustrating the panels and hinge assemblies.

FIG. 7 discloses system 101 including panels 102, 103 with connecting link 110 to form therebetween hinge assembly 104. System 101 is similar to system 71 depicted in FIGS. 5 and 6 except that the panels are of thinner construction, and they do not incorporate the use of compressible track guides since they are intended for use on smaller openings. The seal around the perimeter of these panels may be created by using various forms of weather stripping and/or magnetic tape around the edges of the panels or opening. It becomes more apparent from this embodiment that the connecting link 110 is itself part of the continuous thermal barrier system. This system may be opened vertically with the use of a pull cord, and folded upwards into a valance above a window. It may also be mounted on the sides of a window like a conventional shutter, and fold or bifold closed horizontally.

Figure 8:
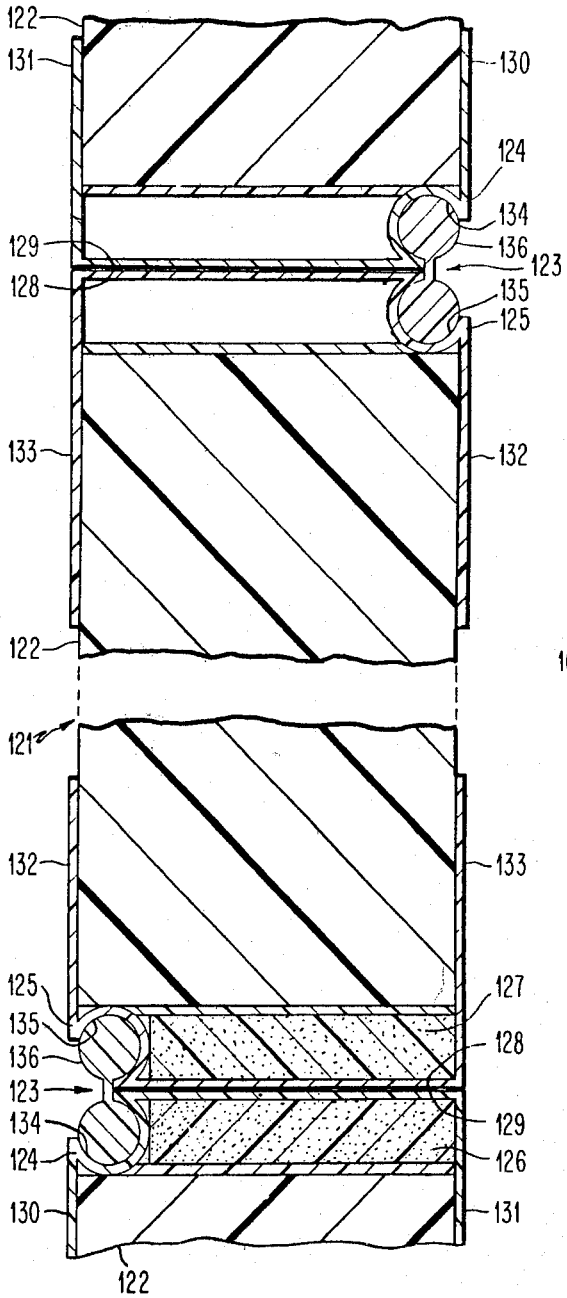
FIG. 8 is a cross sectional view of another embodiment of a continuous moveable thermal barrier system utilizing an end cap assembly.

Another embodiment of a continuous moveable thermal barrier system illustrated in FIG. 8 at 121 is seen as including panels 122 with hinge or end cap assemblies 123 extending therebetween.

The assembly 123 includes a pair of end cap members 124, 125, each an extruded plastic shell that may be hollow or, as illustrated, filled with insulating foam material 126, 127.

End cap members 124, 125 include end pieces 128, 129 and flat side portions 130, 131 and 132, 133 integral therewith and at right angles to the end pieces 128, 129.

Sockets 134, 135 which taper towards their openings are provided at the edges of the end cap members 124, 125. A connecting section 136 extends therebetween. Connecting section 136 is illustrated as a hard plastic member, but for some applications it may be larger, and an extruded plastic shell which can be filled with insulating foam material.

In use, end cap members 124, 125 are applied, as by adhesive over the ends of panels and the connecting section 136 press fit lengthwise within sockets 134, 135. End plates and tracks similar to those in system 71 may also be incorporated in this system.

Figure 9:
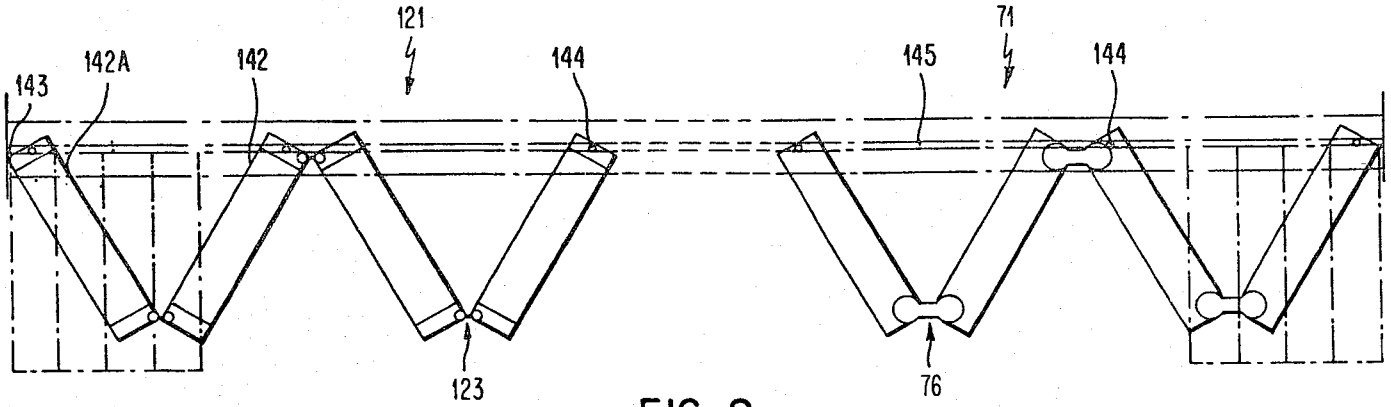
FIG. 9 is an orthographic top plan view depicting portions of the continuous moveable thermal barrier systems in FIG. 5 and FIG. 7 in a partially unfolded position and illustrates, in phantom, the stacked condition of these systems' panels in open or folded position.

FIG. 9 depicts portions of a continuous, moveable thermal barrier systems 71 and 121 constructed in accordance with the teachings of the present invention. The systems are illustrated as comprising a series of panels 142 which are hinged to each other along adjacent vertical edges either by hinge assemblies of the type depicted in FIG. 5, or end cap assemblies 123 depicted in FIG. 8.

The innermost panel 142A may be hinged in the continuous manner to a vertical frame member 143 as at the sidewall of a door or window, or may be sealed along the sides of the opening with the use of weather stripping that will come in contact with the end of the panels when they are in a closed position. Pins 144 extending from the panels 142 move within a track assembly 145 and in sealing engagement therewith from a fully closed position (now shown), partially opened position (as illustrated), or completely open, stacked position (shown in phantom).

In the continuous thermal barrier systems thus far illustrated movement has been by pivotal action of panels about axes at their edges. It is sometimes desirable that the system be flexible as in the case of garage doors and the like.

Figure 10A:
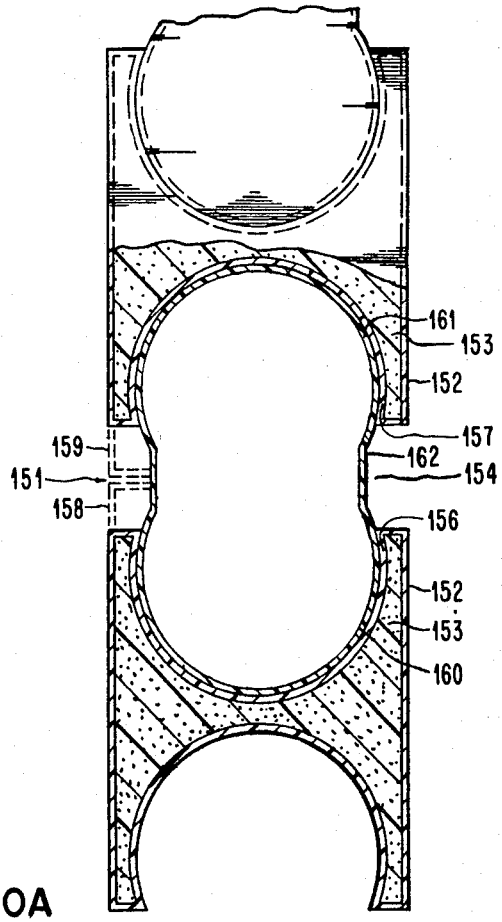
FIG. 10A is a view similar to FIG. 10, but with a hollow connecting section; and, FIG. 11 is an oblique cross sectional view, illustrating the interior and side elevation of the flexible wall in FIG. 10 mounted in a track assembly.
Figure 10:
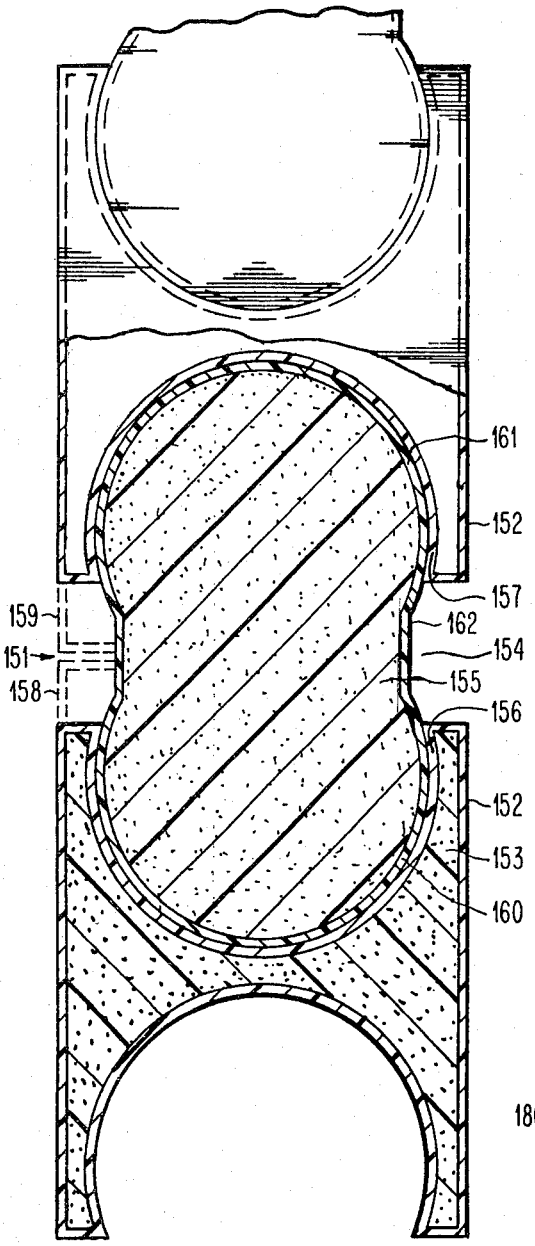
FIG. 10 is a cross sectional view, partially cut away, of a continuous, flexible thermal barrier system.

Referring to FIG. 10 such a system 151 is seen as including a plurality of extruded plastic shells 152 which may be hollow or, as illustrated, filled with insulation 153, and connecting sections 154 therebetween. The connecting sections 154 are plastic extruded hard shell members which may be hollow (FIG. 10A) or, as illustrated, filled with insulation 155.

The shells 152 include open generally cylindrical sockets 156, 157. The sockets 156, 157 while close to being cylindrical in cross section are, in reality, pear-shaped or egg-shaped, tapering tighter toward the opening. If desired, the sockets 156, 157 may be extended along one side in a straight line, as at 158, 159 so as to provide a generally flat surface along one side and limit flexing to the opposite side only.

The connecting sections include a pair of opposed cylindrical shaped members 160, 161 and a flat central portion 162 extending therebetween.

Figure 11:
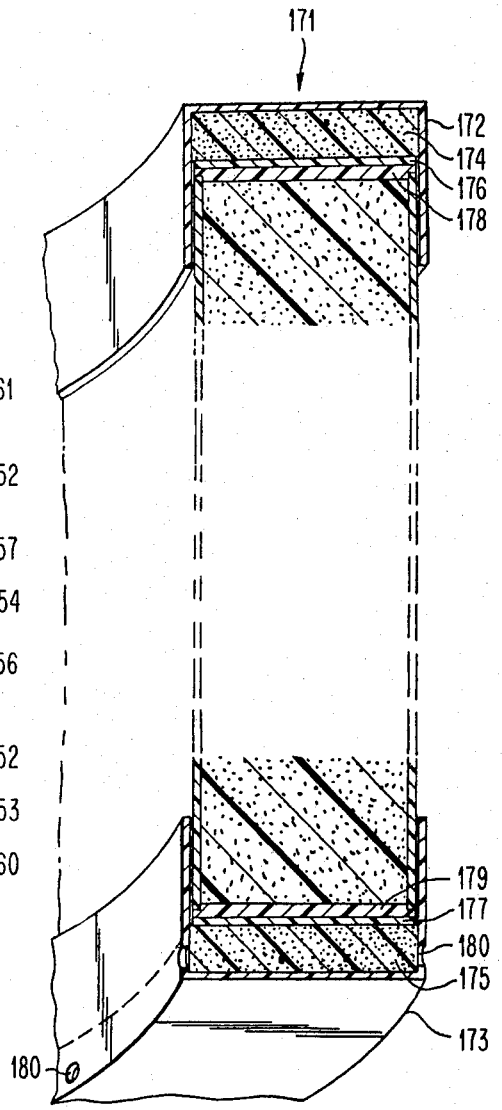

Referring to FIG. 11, there is illustrated an extruded track assembly 171 within which the flexible system slides. The track may be set up for the wall to travel horizontally or vertically. Assuming horizontal movement then track assembly 171 is seen as including an upper and lower curved, U-shaped in cross section, wall receiving members 172, 173. Sandwiched within the members 172, 173 is compressible flexible insulating foam material 174, 175 with thin, smooth strips 176, 177 of flat extruded plastic over same to create a smooth sliding surface. Top and bottom end plates 178, 179 are similar to those of system 71 and create a smooth surface on the ends of the shells and connection sections.

In use, the socket portions 156, 157 of the shells 152 are press fit over the cylindrical portions 160, 161 of the connecting sections 154. In this manner, a flexible wall is formed. The wall is then fed into the track assembly. The compressible foam 174, 175 urge the strips 176, 177 into contact with the adjacent surfaces of the shell and connecting section end plates 152, thereby creating a seal along the entire top and bottom of the system.

Weepholes 180 may be placed in bottom track 173 to prevent and avoid water from building up and icing in winter months on exterior applications.

It should be obvious that changes, additions and omissions may be made in the details and arrangement of parts without departing from the scope of the invention as defined in the appended claims.

What is claimed is:

1. A hinge assembly for use in a continuous moveable, paneled, thermal barrier system, enabling the panels of the system to be moved from in-use position to out-of-the-way storage or open position, said assembly being constructed in such manner as to maintain high thermal insulating efficiency thereby greatly increasing the overall thermal insulating efficiency of the system, said assembly and, further, which permits pivotal motion about two parallel axes, comprising:

a pair of separate, spaced apart elongated hinge members of thermal insulating material, each of whose configuation is that of a hollow shell thereby creating an air space which serves to increase thermal insulating efficiency, said shell including at least a generally open socket, the angle of the opening being less than 180°; and, an elongated hinge member of thermal insulating material whose configuration is that of a hollow shell thereby creating an air space which serves to increase thermal insulating efficiency, said shell including at least a pair of opposed interconnecting inserts;

said inserts adapted to be pressure sealed within a respective one of said sockets while being capable of relative angular movement therein, thereby providing a continuity of thermal insulating performance at the interconnection of adjacent panels of the system while permitting relative pivotal motion therebetween and about two parallel axes.

2. A hinge assembly for use in a continuous, moveable, paneled, thermal barrier system, enabling the panels of the system to be moved from in-use position to out-of-the-way storage or open position, said assembly being constructed in such manner as to maintain high thermal insulating efficiency thereby greatly increasing the overall thermal insulating efficiency of the system, said assembly permitting pivotal motion about two parallel axes as well as adjacent parallel stacking of panels, comprising:

a pair of separate, spaced-apart elongated hinge members of thermal insulating material, each of whose configuration is that of a hollow shell thereby creating an air space which serves to increase thermal insulating efficiency, said shell including at least a general open socket, the angle of opening being approximately 90° and positioned from 180° to 270° relative to the panels;

an elongated hinge member of thermal insulating material whose configuration is that of a hollow shell thereby creating an air space which serves to increase thermal insulating efficiency, said shell including at least a pair of opposed interconnecting inserts;

said inserts adapted to be pressure sealed within a respective one of said sockets while being capable of relative angular movement therein, thereby providing a continuity of thermal insulating performance at the interconnection of adjacent panels of the system while permitting relative pivotal motion therebetween and about two parallel axes and permitting parallel stacking of adjacent panels.

3. A hinge assembly for use in a continuous, moveable, paneled, thermal barrier system, enabling the panels of the system to be moved from in-use position to out-of-the-way storage or open position, said assembly being constructed in such manner as to maintain high thermal insulating efficiency thereby greatly increasing the overall thermal insulating efficiency of the system, said assembly comprising:

a first elongated hinge member of thermal insulating material whose configuration is that of a hollow shell thereby creating an air space which serves to increase thermal insulating efficiency, said shell including at least a generally open socket, the angle of the opening being less than 180°; and, a second elongated hinge member of thermal insulating material whose configuration is also that of a hollow shell, said shell including at least an interconnecting insert, said insert adapted to be pressure sealed within said socket while being capable of relative angular movement therein, thereby providing a continuity of thermal insulating performance at the interconnection of adjacent panels of the system while permitting relative pivotal motion therebetween.

4. A continuous, moveable, paneled, thermal barrier system which enables said panels of said system to be moved from in-use position to out-of-the-way storage or open position, comprising:

a plurality of elongated panels of thermal insulating material whose configuration is that of a hollow shell thereby creating an air space which serves to increase thermal insulating efficiency; and, a plurality of claim 3 hinge assemblies interconnecting adjacent panels.

5. The invention defined by claim 3, wherein said socket tapers inwardly from a widest central position decreasing in radius towards the opening thereby creating a socket of generally egg or pear shaped configuration.

6. The invention according to claim 3 wherein at least one of said shells is an extruded plastic.

7. The invention according to claim 3, wherein at least one of said shells is filled with thermal insulating material.

8. The invention according to claim 3, wherein at least one of said hinge members is an integral part of a panel.

9. The invention defined by claim 3, or 5 wherein said insert is slightly larger than said socket.

10. The invention according to claim 3, 1, 2 or 4 wherein at least one of said hinge members includes a mounting surface for affixing to a panel.

* * * * *